US006162091A

United States Patent [19]

Kurotori et al.

[11] Patent Number: 6,162,091

[45] Date of Patent: Dec. 19, 2000

[54] CONNECTOR

[75] Inventors: Fumio Kurotori; Osamu Daikuhara; Hideo Miyazawa, all of Tokyo, Japan

[73] Assignee: Fujitsu Takamisawa Component Limited, Tokyo, Japan

[21] Appl. No.: 09/244,042

[22] Filed: Feb. 4, 1999

[30] Foreign Application Priority Data

Aug. 3, 1998 [JP] Japan ..... 10-219242

[51] Int. Cl.[7] ..... H01R 13/73

[52] U.S. Cl. ..... 439/567; 439/571; 439/79

[58] Field of Search ..... 439/79, 567, 571–573

[56] References Cited

U.S. PATENT DOCUMENTS

| | | | |
|---|---|---|---|
| 5,697,812 | 12/1997 | Sampson et al. | 439/567 |
| 5,797,768 | 8/1998 | Francaviglia | 439/567 |
| 5,822,855 | 10/1998 | Szczesny et al. | 439/79 |

FOREIGN PATENT DOCUMENTS

| | | |
|---|---|---|
| 56-128582 | 10/1981 | Japan . |
| 1-258370 | 10/1989 | Japan . |
| 4-48557 | 2/1992 | Japan . |
| 2549644 | 6/1997 | Japan . |
| 11-26107 | 1/1999 | Japan . |

*Primary Examiner*—Gary F. Paumen
*Attorney, Agent, or Firm*—Staas & Halsey LLP

[57] ABSTRACT

A connector includes a connector main body and a plurality of terminals, the connector main body being provided with hook parts which can be engaged to notch parts of a printed-circuit board so as to temporarily fix the connector to the printed-circuit board. The connector main body is provided with pins which move within a small region when the pins are forced to move, and, to achieve the temporarily fixed state, the pins are forced to move slightly so that the pins are fitted into openings provided in the printed-circuit board.

16 Claims, 9 Drawing Sheets

F11

CONNECTOR

BACKGROUND OF THE INVENTION

1. Field of the Invention

The present invention generally relates to a connector, and particularly relates to a connector which is, first, temporarily fixed at a front edge of a printed-circuit board and then passed through a reflow oven for being mounted on the front edge of the printed-circuit board with its terminals soldered on pads provided on the printed-circuit board.

2. Description of the Related Art

In the related art, a connector is known which connector is mounted on a front edge of a printed-circuit board with terminals being soldered on respective pads provided on the printed-circuit board and the connector protruding from the front edge of the printed-circuit board. The connector of this kind is temporarily fixed on the front edge of the printed-circuit board and then passed through a reflow oven for being mounted on the front edge of the printed-circuit board with its terminals soldered on pads provided on the printed-circuit board. In order to solder all of the terminals on the pads provided on the printed-circuit board with comparatively good reliability, it is required that the temporary fixing of the connector to the front edge of the printed-circuit board be achieved in a completely secure manner. Also, with regard to manufacturing efficiency, it is required that the connector be temporarily fixed on the front edge of the printed-circuit board with a comparatively high efficiency.

FIG. 1A is a perspective diagram showing a connector 10 of the related art together with the printed-circuit board 11. The connector 10 is provided with a connector main body 12 and a plurality of terminal members 13 assembled to the connector main body 12. The connector main body 12 is provided with arm parts 14 and 15 provided on respective ends of the connector main body 12. The arm parts 14 and 15 are provided with downward hook parts 16 and 17, respectively. The printed-circuit board 11 is provided with notch parts 21, 22 provided on respective side edges. The notch parts 21, 22 are placed at positions near a front edge 20 and correspond to the arm parts 14, 15 and hook parts 16, 17. Reference numerals 23 and 24 indicate supporting parts provided between the front edge 20 and the notch parts 21, 22, respectively.

FIGS. 1B to 1D are diagrams showing the connector 10 in a connected state in which the connector 10 is protruded out of the front edge 20 of the printed-circuit board 11. As shown in FIGS. 1B and 1C, the hook parts 16, 17 are fitted in the notch parts 21, 22 and the arm parts 14, 15 are supported by the supporting parts 23, 24. As shown in FIG. 1D, each of the terminal members 13 includes a projected portion 13*a* projecting backwards from the connector main body 12. The projected portions 13*a* are soldered to respective pads 25 by solder 26.

The projected portions 13*a* are soldered on the pads 25 with the hook portions 16, 17 being fitted into the notch parts 21, 22. In other words, the connector 10 is temporarily fixed on the printed-circuit board 11.

The temporarily fixed state of the connector 10 is a state where the hook parts 16, 17 are simply fitted into the notch parts 21, 22. Therefore, if there is any looseness between the hook parts 16, 17 and the notch parts 21, 22, the connector 10 will tilt downwards, and, thus, the projected portions 13*a* will come off the pads 25, as shown in FIG. 2. This results in an unsuccessful soldering of the projected portions 13*a* and the pads 25 during a reflow process. Therefore, the reliability of the soldering process will be decreased.

In order to prevent the above-described problem, a dimensional accuracy of the hook parts 16, 17 and the notch parts 21, 22 may be improved. Then, because the hook parts 16, 17 and the notch parts 21, 22 will tightly fit together, the tilting of the connector 10 with respect to the printed-circuit board 11 may be suppressed. However, with such a structure, it is rather difficult to fit the hook parts 16, 17 into the notch parts 21, 22, so that it is also difficult to temporarily fit the connector 10 on the printed-circuit board 11.

SUMMARY OF THE INVENTION

Accordingly, it is a general object of the present invention to provide a connector which can solve the problems described above.

It is another and more specific object of the present invention to provide a connector without any looseness when temporarily fixed on a front edge of a printed-circuit board.

In order to achieve the above object, a connector is provided which includes a connector main body and a plurality of terminals, the connector main body being provided with hook parts which can be engaged to notch parts of a printed-circuit board so as to temporarily fix the connector to the printed-circuit board, wherein the connector main body is provided with pins which move within a small region when the pins are forced to move, and, to achieve the temporarily fixed state, the pins are forced to move slightly so that the pins are fitted into openings provided in the printed-circuit board.

With the connector described above, since the pin is movable in a small region, variation in positioning, such as that of notch parts in the printed-circuit board, will be negligible, thus avoiding any looseness. Also, since the pin is movable in a small region, a temporary fixing of the connector to the printed-circuit board is facilitated.

It is still another object of the present invention to provide a connector having a simple structure in which a lower half part of a pin protruding from a connector main body can be slightly moved in a direction towards the front face of the connector main body.

In order to achieve the above object, the connector main body is provided with bores, each of which being formed such that its top cross section is circular and its bottom cross section is elliptical with the major axis extending in a direction of depth of the connector, the top cross-section and the bottom cross section being connected by a side wall, the connector main body is provided with pins penetrating through the bores, each of the pins being pivotable about a center of the top cross section within a small region defined by the side wall, a lower half part of the pin protruding downwards from the bore being movable in a direction toward the front of the connector when a forward force is exerted on the lower half part, and, to achieve temporarily fixed state, the pins are forced to pivot slightly so that the lower half parts of the pins are fitted into openings provided in the printed-circuit board.

It is yet another object of the present invention to provide a connector having a pin which can be fixed by a frictional force.

In order to achieve the above object, the pin is provided with a plurality of ribs protruding from the periphery of an upper half part of the pin.

It is yet another object of the present invention to provide a connector wherein it is easy to implement a fitting operation of the pin into an opening provided in a printed-circuit board.

In order to achieve the above object, the pin is provided with a tapered part at the bottom end of the lower half part of the pin, and the pin is slightly moved so as to fit the pin into the opening provided in the printed-circuit board with its tapered part being guided to an edge part of the opening of the printed-circuit board.

It is yet another object of the present invention to provide a connector having a simple structure and without any looseness when temporarily fixed on a front edge of a printed-circuit board.

In order to achieve the above object, the connector main body is provided with pins implanted therein, each of the pins being constructed such that a lower half part of the pin protruding downwards from the connector main body is elastically deformable so that a diameter of the pin decreases, and to achieve the temporarily fixed state, the lower half parts of the pins being elastically deformed so that the pins being fitted into openings provided in the printed-circuit board.

Also, with the connector described above, the variation of the positioning, such as that of notch parts in the printed-circuit board, will be negligible, thus avoiding any looseness.

It is yet another object of the present invention to provide a connector which has a power supply connector part with improved mechanical strength.

In order to achieve the above object, the connector further includes a power supply connector art, to which a power supply connector is connected, the pins being provided at positions corresponding to the power supply connector part.

Other objects and further features of the present invention will be apparent from the following detailed description when read in conjunction with the accompanying drawings.

DETAILED DESCRIPTION OF THE PREFERRED EMBODIMENTS

In the following, principles and embodiments of the present invention will be described with reference to the accompanying drawings.

Figure 1A:
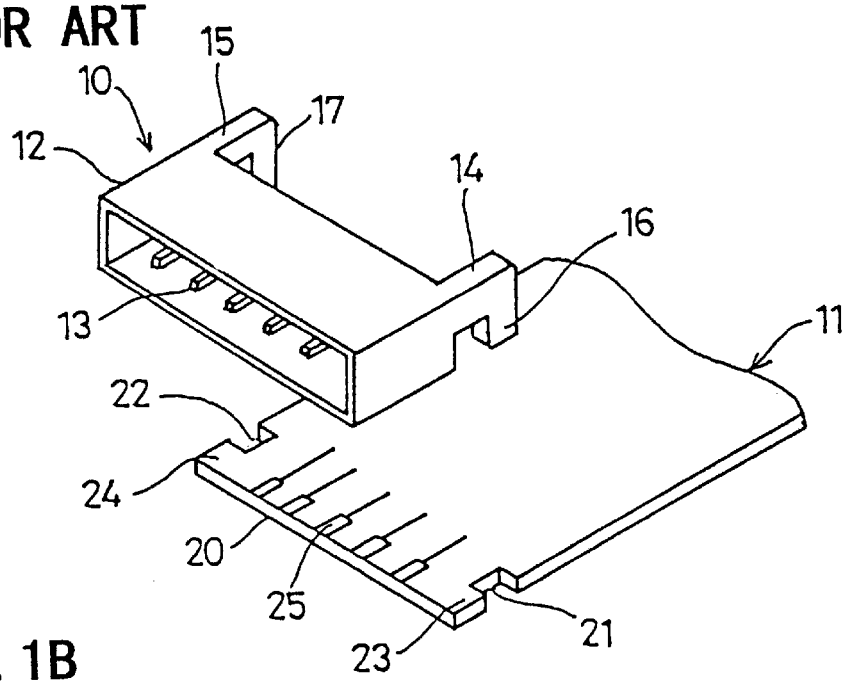
FIG. 1A PRIOR ART
FIGS. 1A and 1B are perspective views and FIGS. 1C and 1D are cross-sectional views showing a connector of the related art together with a printed-circuit board.
Figure 1B:
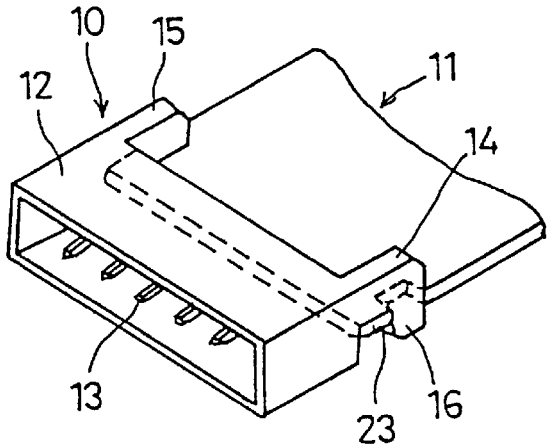
FIG. 1B PRIOR ART
Figure 1C:
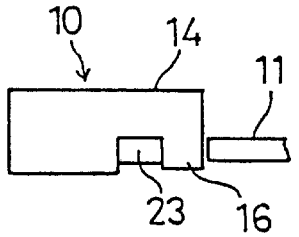
FIG. 1C PRIOR ART
Figure 1D:
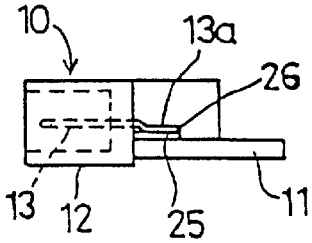
FIG. 1D PRIOR ART
Figure 2:
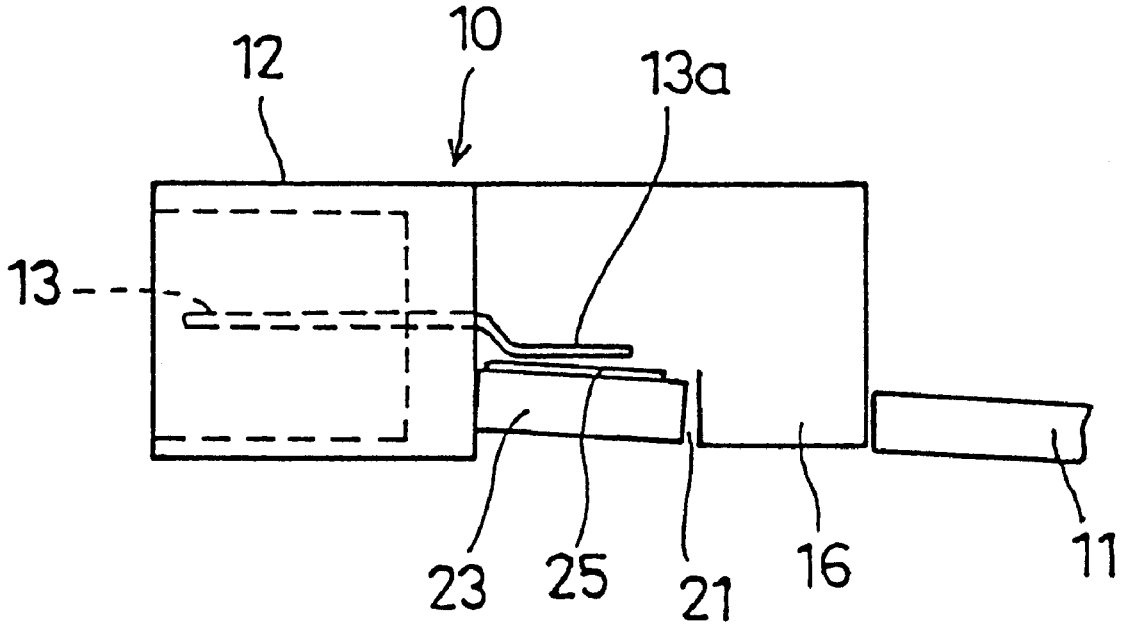
FIG. 2 PRIOR ART
FIG. 2 is a cross-sectional view of the connector of the related art, particularly showing a problematic aspect thereof.
Figure 3:
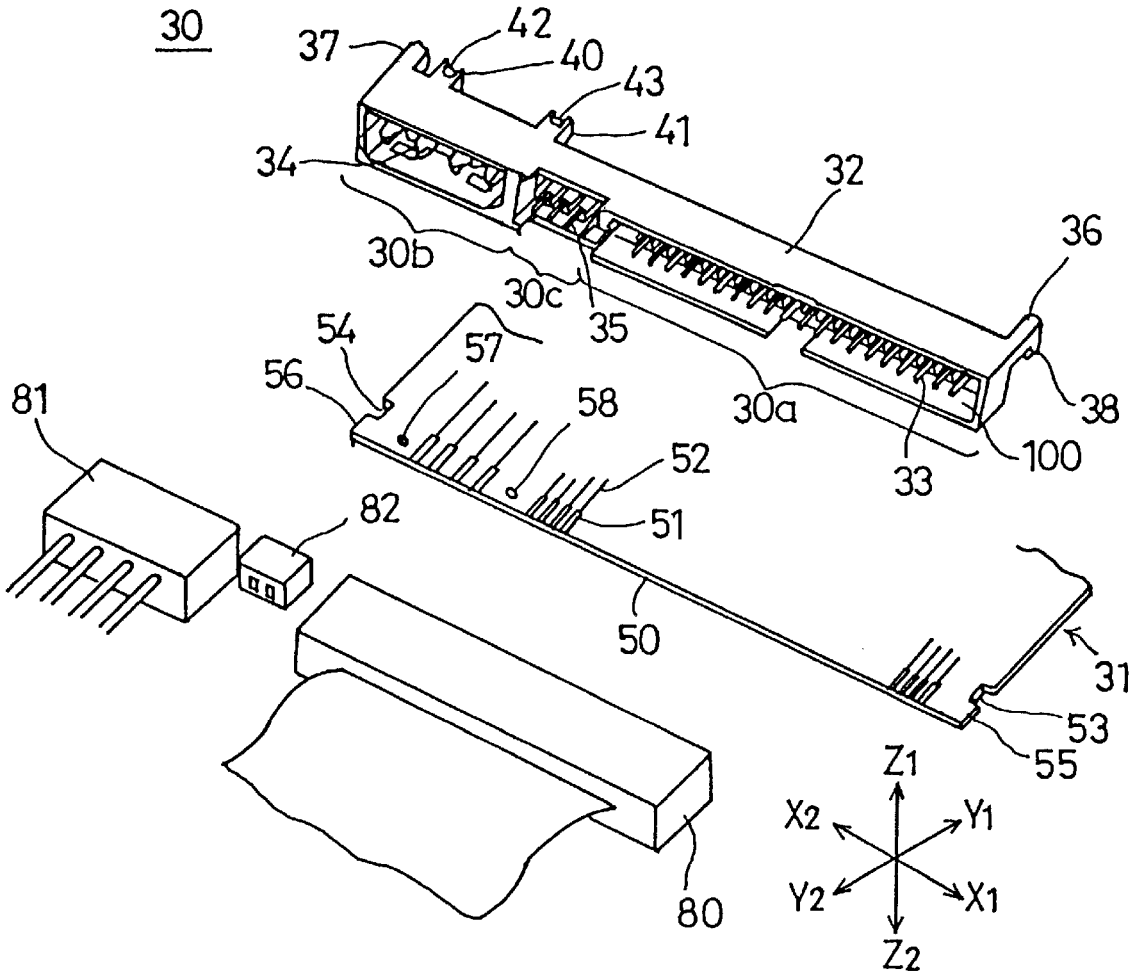
FIG. 3 is a perspective diagram of a connector of a first embodiment of the present invention shown together with other components such as a printed-circuit board.
Figure 4A:
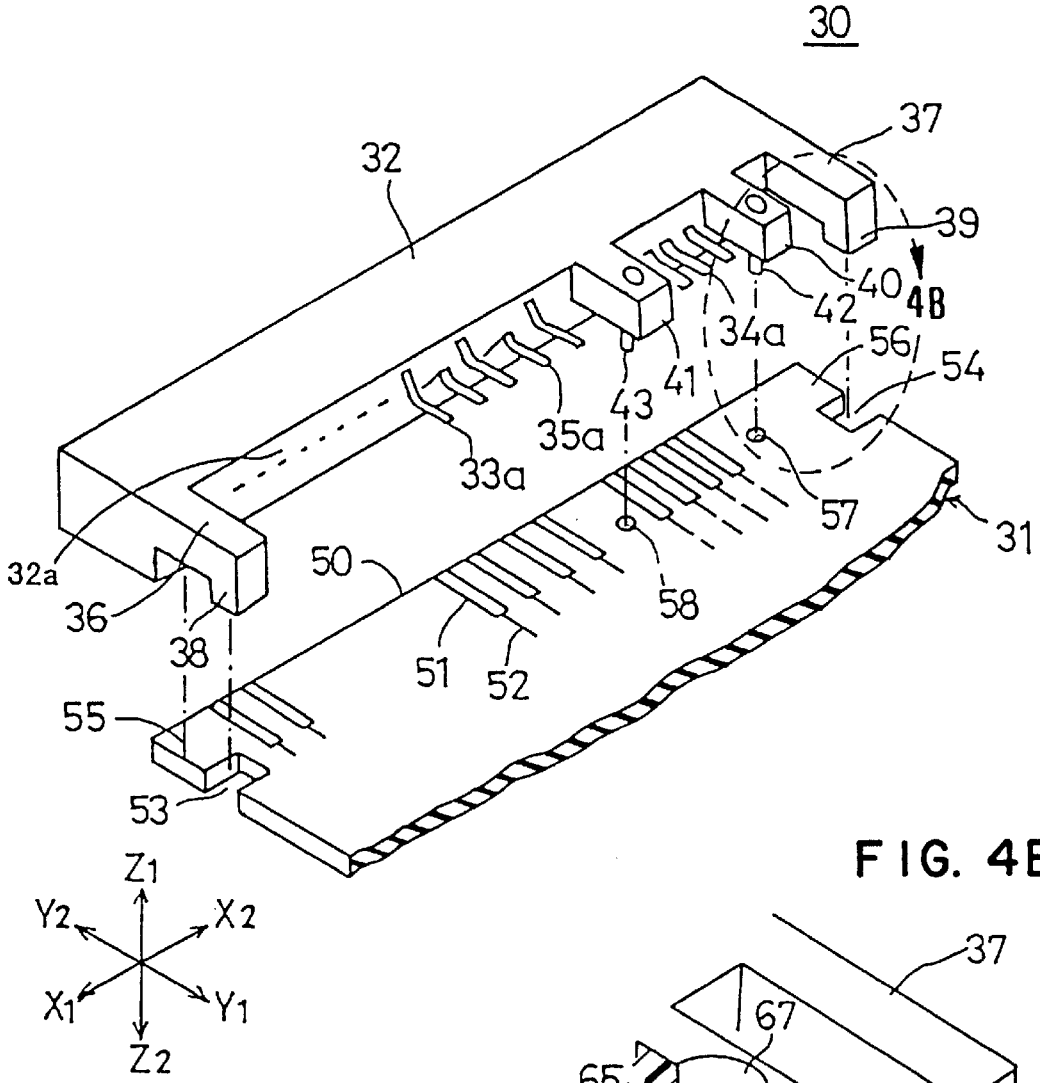
FIG. 4 is a backside perspective diagram of the connector shown in FIG. 3.
Figure 4B:
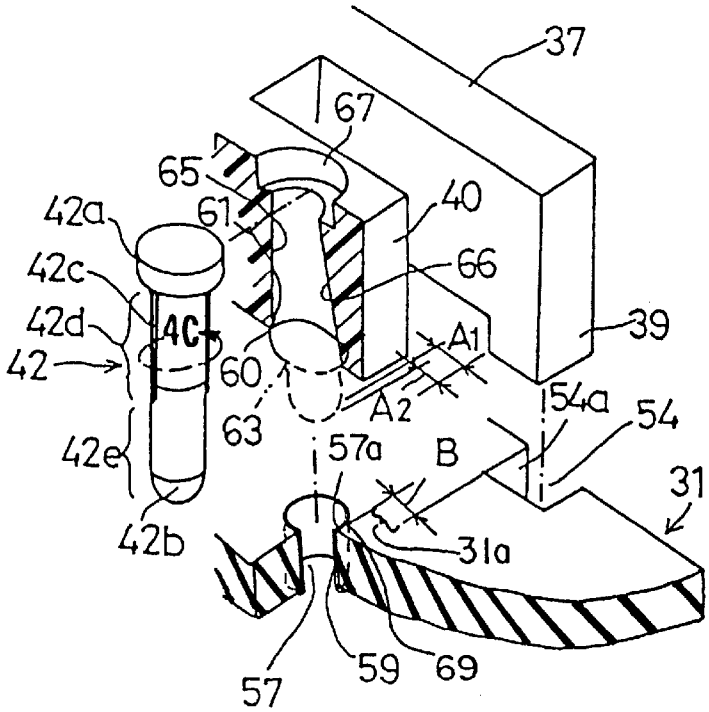
Figure 4C:
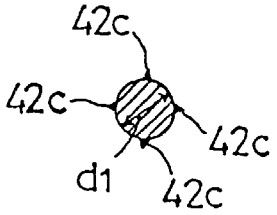

FIGS. 3 and 4 are diagrams showing a connector 30 of a first embodiment of the present invention together with a printed-circuit board 31. The connector 30 is provided with a connector main body 32 and a plurality of terminal members 33, 34, 35 assembled to the connector main body. The connector main body 32, which is a molded component, is made of synthetic resin and has a shape of an elongated rectangular box. In the Figures, directions X1 and X2 correspond to the width of the connector 30, directions Y1 and Y2 correspond to the depth of the connector 30 and directions Z1 and Z2 correspond to the height of the connector 30. Reference numeral 100 shows a front face of the connector 30.

The connector 30 includes a signal connector part 30*a*, a power supply connector part 30*b* and an ID connector part 30*c*, all of which are integrated in the connector 30. The signal connector part 30*a* is provided with a plurality of the terminal members 33. The ID connector part 30*c* is provided with a plurality of the terminal members 35. The power supply connector part 30*b* is provided with a plurality of the terminal members 34, provided adjacent to an X2 direction end. Each of the terminal members 33, 34, 35 penetrates a back plate 32*a* of the connector main body 32, and terminal portions 33*a*, 34*a*, 35*a* project out of the connector main body 32 in the Y1 direction. The terminal portions 33*a*, 34*a*, 35*a* are all arranged in the same X-Y plane.

The connector main body 32 is provided with arm parts 36, 37 at the X1 and X2 ends, respectively, which arm parts extend in the Y1 direction. The arm parts 36, 37 are provided with hook parts 38, 39, respectively, formed at the tip of the arm parts 36, 37 and protruding in the Z2 direction.

Also, the connector main body 32 is provided with arm parts 40 and 41. The arm part 40 extends in the Y1 direction and is placed at a position corresponding to one of the power supply connector parts 30*b* provided closest to the arm part 37. The arm part 41 extends in the Y1 direction and is placed at a position between the power supply connector part 30*b* and the ID connector part 30*c*. The arm parts 40, 41 are provided with pins 42, 43, respectively, which penetrate through the arm parts 40, 41 in the Z2 direction.

The pins 42, 43 will be described in detail in the following, and have functions of providing an, easy temporary fixing operation, preventing looseness resulting from the temporary fixing operation, and reinforcing the power supply connector part 30*b*.

The printed-circuit board 31 has a width equal to that of the connector 30 and a plurality of pads 51 are provided along its front edge 50 so as to correspond to the above-described terminal portions 33*a*, 34*a*, 35*a*. Each pad 51 is provided with a wiring pattern 52 extending therefrom. The printed-circuit board 31 has notch parts 53, 54 on side edges, respectively, at positions near the front edge 50, the notch parts 53, 54 corresponding to the arm parts 36, 37 and hook parts 38, 39. Reference numerals 55 and 56 indicate supporting parts provided between the front edge 50 and the notch parts 53, 54, respectively. Also, the printed-circuit board 31 is provided with openings 57, 58 corresponding to the pins 42, 43, respectively. The openings 57, 58 are each provided with an inner wall layer 59 of, for example, solder.

Figure 5A:
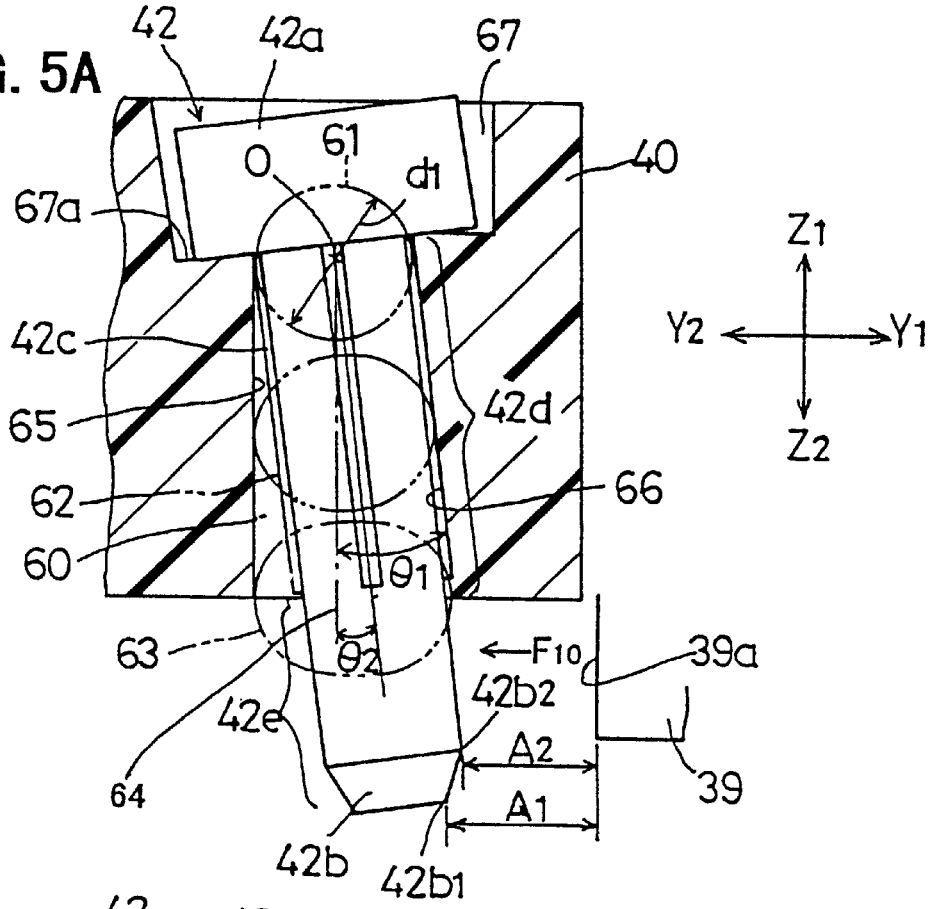
FIG. 5A is cross-sectional diagram showing a pin provided in an inclined position and FIG. 5B is cross-sectional diagram showing the pin provided in an upright position.

Now, the pin 42 will be described in detail. As shown in FIGS. 4 and 5A, the arm part 40 is provided with a bore 60.

The bore 60 has a non-uniform cross-sectional shape. The upper end has a shape of a circle 61 having a diameter d1, which is the same as that of the pin 42. The cross section of the bore 60 becomes a slightly elliptical shape 62 and at the lower end the cross-section of the bore 60 is an elliptical shape 63. This enables the pin 42 to be inclined, the upper end of the pin 42 to be supported without being moved, and the lower end of the pin 42 to be moved in the Y2 direction. Reference numeral 64 indicates the line of axis which is a vertical line in the Z1 and Z2 directions passing through the center of the above-described circle 61. The inner wall of the bore 60 has a first inner wall part 65 and a second inner wall part 66. The first inner wall part 65 is a Y2-direction part of the inner wall and is a vertical surface extending in the Z1-Z2 directions. The second inner wall part 66 is a Y1-direction part of the inner wall and is an inclined surface with the Z2 end being moved towards the Y1-direction.

The above-described inclination is shown in the figure in a somewhat exaggerated manner. The bore 60 is, in other words, a space defined by a pole having a diameter d1 by pivoting such pole about its upper end so that its lower end moves in the Y2 direction. A recessed part 67 for accommodating a head part 42*a* of the pin 42 is provided in an upper surface of the arm part 40 at the upper end of the bore 60. The recessed part 67 is formed such that a Y2-side half 67*a* of the recessed part 67 has a slightly greater depth than that of a Y1-side half. This is to ensure that the head part 42*a* of the pin 42 is accommodated in the recessed part 67 even when the pin 42 is inclined as described below.

The pin 42 has the head part 42*a*, a tapered part 42*b* and a plurality, four in the present embodiment, of ribs 42*c* extending in the axial direction of the pin 42 and protruding at equal intervals. The tapered part 42*b* is provided at the lower end and the ribs 42*c* are provided on an upper half part 42*d*. The rib 42*c* has a triangular cross section. The ridge part abuts the inner surface of the bore 60 so as provide a frictional force for fixing the pin 42.

FIG. 5A is a diagram showing the pin 42 in a slightly inclined state. The pin 42 extends in the bore 60 along the inclined inner surface 66 and protrudes in the Z2-direction. The pin 42 is inclined at an angle θ2 with respect to the line of axis 64. The upper half part 42*d* exists within the bore 60 and a lower half part 42*e* protrudes in the Z2-direction from the bottom surface of the arm part 40. When a comparatively strong force F10 is applied to the lower half part 42*e* in the Y2-direction, the pin 42 is pivoted in a Y2 direction in a small region defined by the bore 60, the axis of pivotal movement being a point 0 directly below the head part 42*a*, and the ribs 42*c* sliding on the inner wall surface of the bore 60. When the force F10 is removed, the pin 42 remains in the position at that instant due to a friction force between the ribs 42*c* and the inner wall surface of the bore 60.

In brief, the pin 42 is constructed so as to pivot within a small region when a comparatively large external force is exerted on the lower half part 42*e* and to remain in that position when the external force is removed.

Figure 5B:
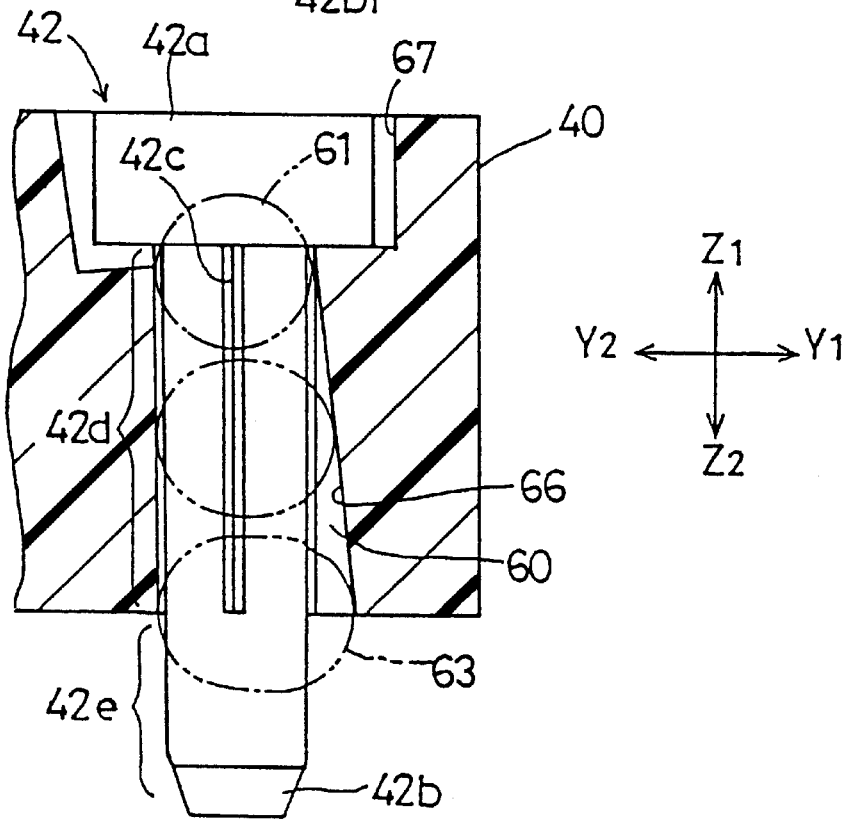

Referring to FIGS. 4, 5A and 5B, dimensional relationships between the pin 42 and the hook part 39 on the connector 30, and the notch part 54 and the opening 57 on the printed-circuit board 31 will be described.

In the following description, all dimensions are taken in the Y1-Y2 directions. FIG. 5A shows the pin 42, which is fixed through the bore 60 in an inclined state. Reference A1 indicates the dimension between an end surface 39*a* of the hook part 39 on the Y2 direction side and a tip 42*b*1 of the tapered part 42*b* of the pin 42. Reference A2 indicates a dimension between an end surface 39*a* of the hook part 39 on the Y2 direction side and a base part 42*b*2 of the tapered part 42*b* of the pin 42. In FIG. 4, reference B indicates a dimension between an end surface 54*a* of the notch part 54 on the Y2 direction side and a tangent at a point 57*a* of the inner periphery of the opening 57. The point 57*a* is a position closest to the Y1 direction side on an edge part 69.

The printed-circuit board 31 is provided with the notch part 54 and the opening 57, which are formed such that the dimension B satisfies the following relationship:

$$A2<B<A1.$$

Therefore, it is not necessary to position the notch part 54 and the opening 57 with a high degree of accuracy. The other pin 43 provided on the arm part 41 has an identical structure to that of the above-described pin 42.

Referring to FIGS. 6A to 6D, processes for temporarily fixing the connector 30 to the printed-circuit board 31 will be described. Although descriptions are made for the pin 42, the figures also show equivalent parts for the other pin 43 with bracketed numerals.

Figure 6A:
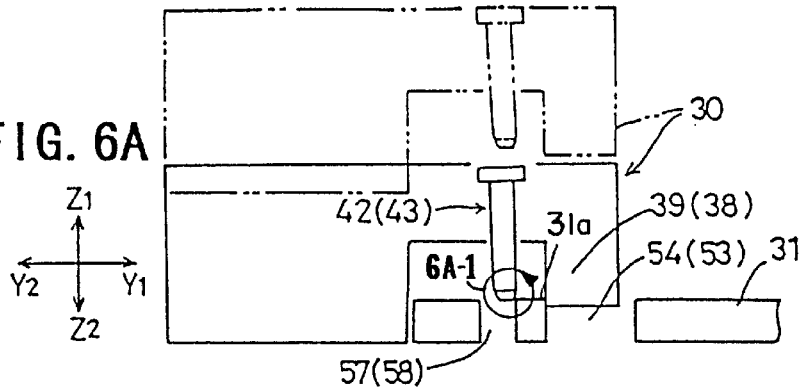
FIGS. 6A to 6D are diagrams showing processes for temporarily fixing and then mounting the connector of the first embodiment on the printed-circuit board.
Figures 1, 6A:
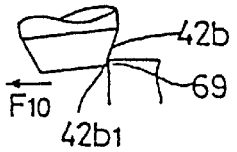

As shown in FIG. 6A, the connector 30 is lowered to a position at an end of the printed-circuit board 31 and then pressed with a comparatively strong force F11 in the Z2-direction.

When the connector is lowered to the position at the end of the printed-circuit board, the lower end side of the hook part 39 (38) fits in the notch part 54 (53). As indicated in an enlarged view in FIG. 6A, the tapered part 42*b* of the pin 42 abuts the edge part 69 of the opening 57 at a position closer to the tip 42*b*1.

Figure 6B:
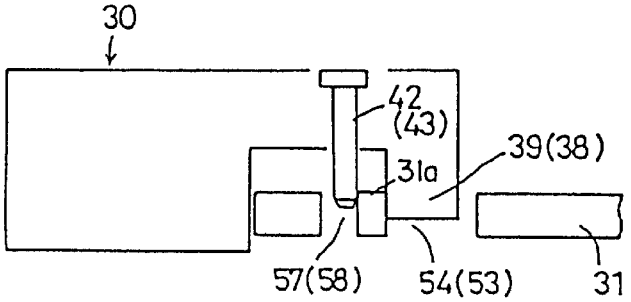

When the connector 30 is pressed with a comparatively strong force F11 in the Z2-direction, the hook part 39 (38) further proceeds into the notch part 54 (53). The tapered part 42*b* is pushed by the edge part 69, thus providing a relatively strong force F10 to the lower half part 42*e* of the pin 42 in the Y2-direction. The pin 42 is moved such that the lower half part 42*e* is moved slightly in Y2 direction, the upper half part 42*d* sliding on a wall surface of the bore 60, the axis of pivotal movement being a point 0 directly below the head part 42*a*, and the ribs 42*c* sliding on the inner wall surface of the bore 60. Thus, the pin 42 is inserted into the opening 57 as shown in FIG. 6B.

Figure 6C:
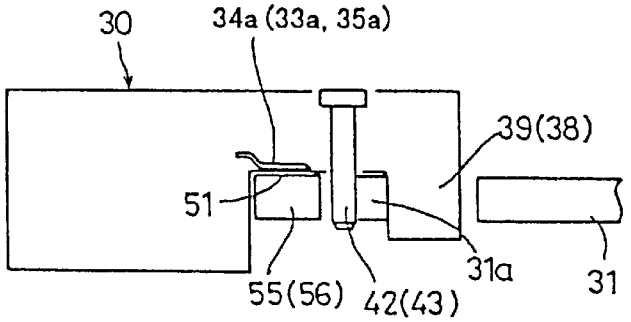

The connector 30 is in a temporarily fixed state in FIG. 6C and FIG. 5B. In the temporarily fixed state, the hook part 39 (38) is completely fitted in the notch part 54 (53), the lower half part 42*e* of the pin 42 is completely fitted in the opening 57 and the other pin 43 is completely fitted in the opening 58. The arm parts 40, 41, shown in FIG. 4, are supported by the supporting parts 55, 56. Thus, the connector main body 32 is in a state such that it is protruded out of the front edge 50 of the printed-circuit board 31 in the Y2-direction.

Consider a case where the lower half part 42*e* the pin 42 (43) is forced so as to pivot in the Y2-direction with the axis of pivotal movement at a point 0 directly below the head part 42*a*. When the lower half part 42*e* comes to a state where it can be inserted into the opening 57, the pin 42 will no longer be moved in the Y2-direction. Instead, the lower half part 42*e* of the pin 42 will slide on the point 57*a*, which is closest to the Y1-direction side of the inner periphery of the opening 57. That is to say, a part 31*a*, with a size B, of the printed-circuit board 31 is securely held between the pin 42 (43) and the hook part 39 (38). Therefore, the connector 30 is temporarily fixed such that it is not inclined with respect to the printed-circuit board 31 and the terminal portions 33*a*, 34*a*, 35*a* abut the corresponding pads 51. Also, the pin 42 (43) will move into the substantially vertical state from the above-described state at minimum inclination.

Note that the temporal fixing may be implemented in an efficient manner, since, as shown in FIG. 6A, the user only needs to lower the connector 30 to the end position of the printed-circuit board 31, and then press in the Z2-direction with the comparatively strong force F11.

Figure 6D:
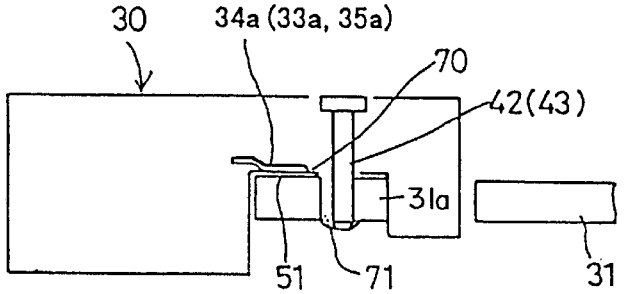

As shown in FIG. 6D, the terminal portions 33*a*, 34*a*, 35*a* will be soldered on the corresponding pads 51 by solder 70. Since the terminal portions 33*a*, 34*a*, 35*a* abut the corresponding pads 51 in the temporarily fixed state, the soldering process will be implemented with high reliability. Also, the pin 42 (43) will be soldered on the opening 57 (58) by solder 71. Thus, the connector 30 is mounted on the printed-circuit board 31.

Finally, this printed-circuit board 31 will be installed in an electronic device with the connector 30 being exposed externally from the electronic device. As shown in FIG. 3, a signal connector 80 is connected to the signal connector part 30*a*, a power supply connector 81 is connected to the power supply connector part 30*b* and ID connector 82 is connected to the ID connector part 30*c*.

The power supply connector 81 requires greater force for insertion and removal, compared to the signal connector 80 and ID connector 82. The above-described pin 42 (43) is provided at, i.e., adjacent the power supply connector part 30*b* so as to exert greater force for fastening the power connector part 30*b* to the printed-circuit board 31. Thus, the power supply connector part 30*b* is reinforced. Therefore, the power connector part 30*b* will not be damaged even when the power supply connector 81 is repeatedly inserted and removed from the power supply connector part 30*b*.

It is to be noted that the opening 57 may be provided with a conical tapered part at the upper end opening side, instead of providing the tapered part 42*b* on the pin 42.

Figure 7A:
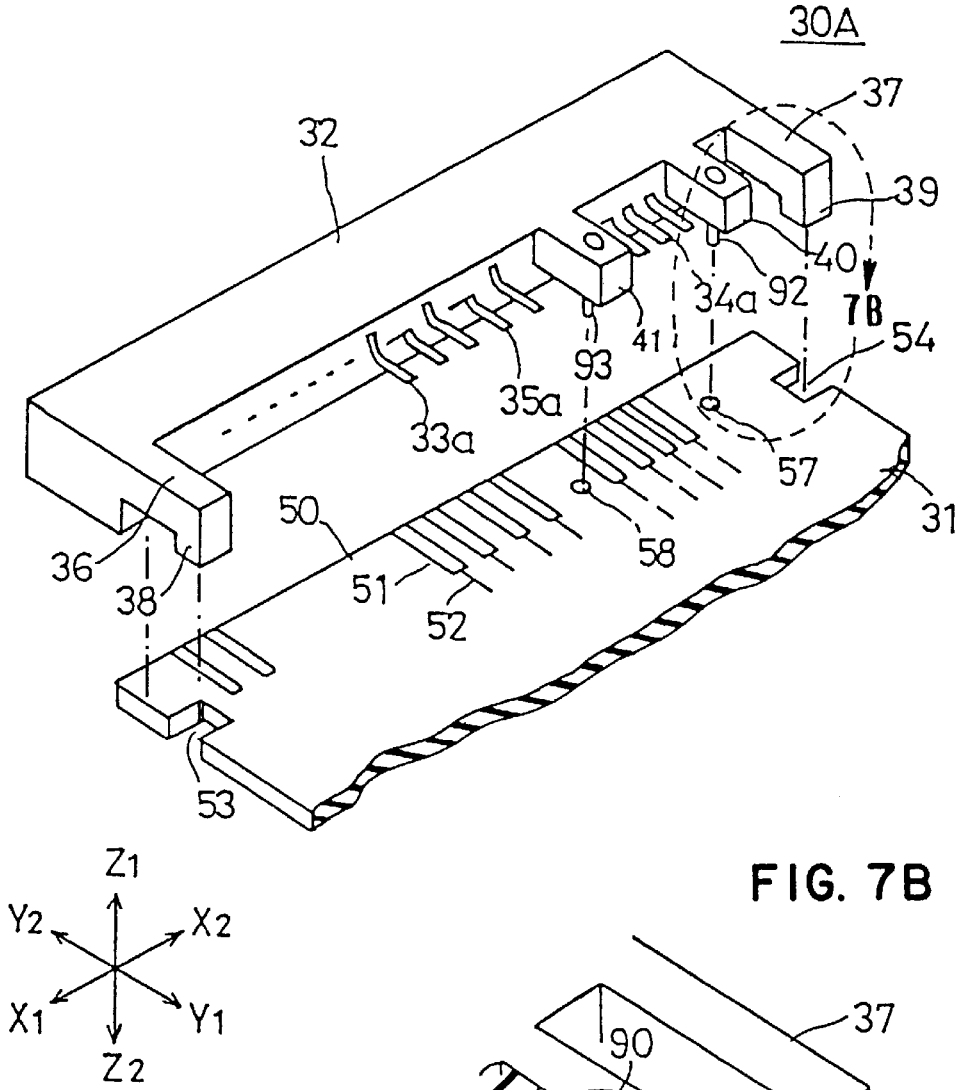
FIG. 7 is a backside perspective diagram of a connector of a second embodiment of the invention.
Figure 7B:
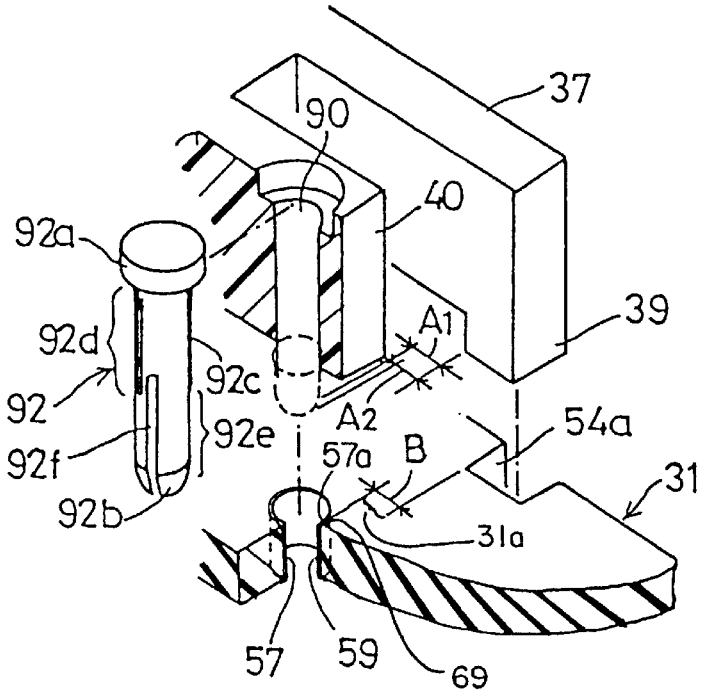
Figure 8A:
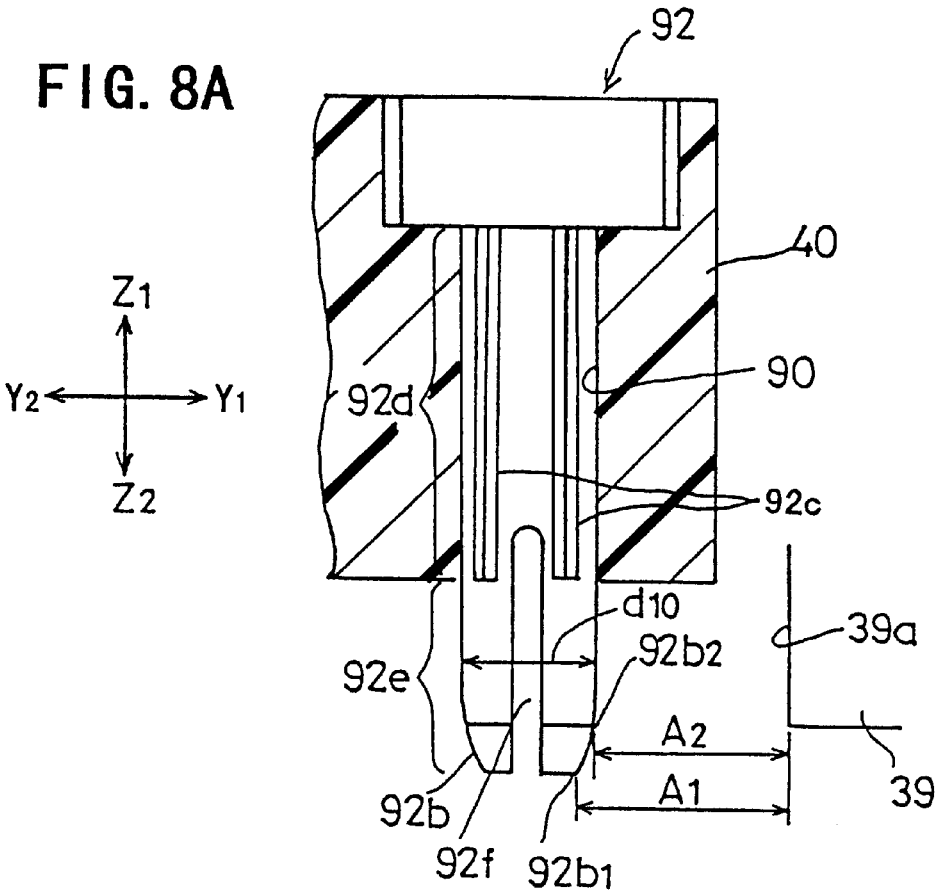
FIGS. 8A and 8B are cross-sectional diagrams showing a structure of a pin.

FIG. 7 is a diagram showing a connector 30A of a second embodiment of the present invention together with the printed-circuit board 31. The connector 30A differs from the above-described connector 30 in that each arm part 40, 41 is provided with a bore 90 having a regular cylindrical shape instead of the bore 60 having a special shape. As shown in FIG. 8A, another difference may be found in that, instead of the pins 42, 43, pins 92, 93 are provided which penetrate through the bore 90 of each arm part 40, 41.

Figure 8B:
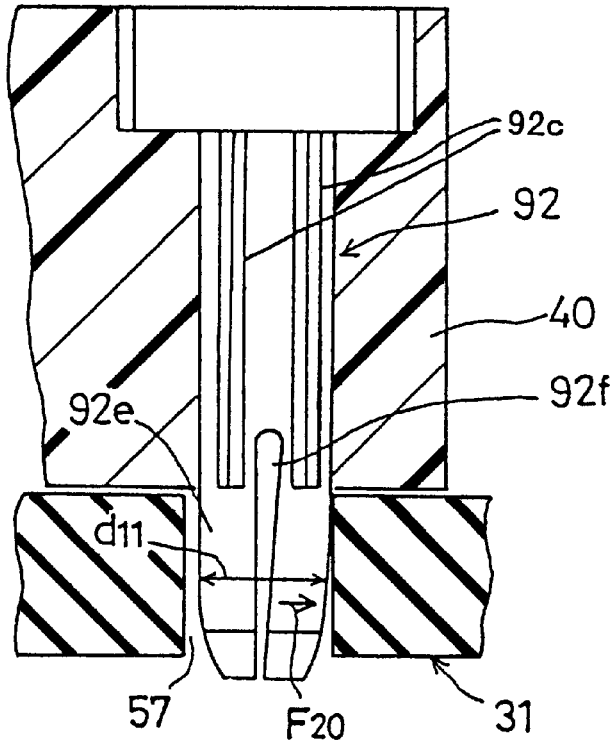

As shown in FIG. 8A, the pin 92 (93) has a head part 92*a*, a tapered part 92*b* and a plurality, four in the present embodiment, of ribs 92*c* extending in the axial direction of the pin 92 and protruding at an equal intervals. The tapered part 92*b* is provided at the lower end and the ribs 92*c* are provided on an upper half part 92*d*. The pin 92 is provided with a slit 92*f*, which is open at the lower end of the lower half part 92*e*. The part provided with the slit 92*f* serves as a press-fitpin. The ribs 92*c* abut against the inner wall of the bore 90 and fix the pin 92 by a frictional force. When viewed in the Y1-Y2 directions, the lower part 92*e* normally has a diameter d10. When the slit 92*f* is narrowed as shown in FIG. 8B, the lower part 92*e* has a smaller diameter d11.

In the following, the dimensional relationship between the pin 92 and the hook part 39 on the connector 30A, and the notch part 54 and the opening 57 on the printed-circuit board 31 will be described.

In the following description, all dimensions are taken in the Y1-Y2 directions. Reference A1 indicates a dimension between the end surface 39*a* of the hook part 39 on the Y2 direction side and a tip 92*b*1 of the tapered part 92*b* of the pin 92 fixed through the bore 90. Reference A2 indicates a dimension between the end surface 39*a* of the hook part 39 on the Y2 direction side and a base part 92*b*2 of the tapered part 92*b* of the pin 92 fixed through the bore 90. Reference B indicates the dimension between the end surface 54*a* of the notch part 54 on the Y2 direction side and the tangent at the point 57*a* of the inner periphery of the opening 57. The point 57*a* is the position closest to the Y1 direction side on the edge part 69.

The printed-circuit board 31 is provided with the notch part 54 and the opening 57, which are formed such that the dimension B satisfies the following relationship:

$$A2<B<A1.$$

The other pin 93 has an identical structure to that of the pin 92.

In the following, processes for temporarily fixing the connector 30A having the above-described structure to the printed-circuit board 31 will be described.

Referring to FIGS. 9A to 9*d*, processes for temporarily fixing the connector 30A to the printed-circuit board 31 will be described.

Figure 9A:
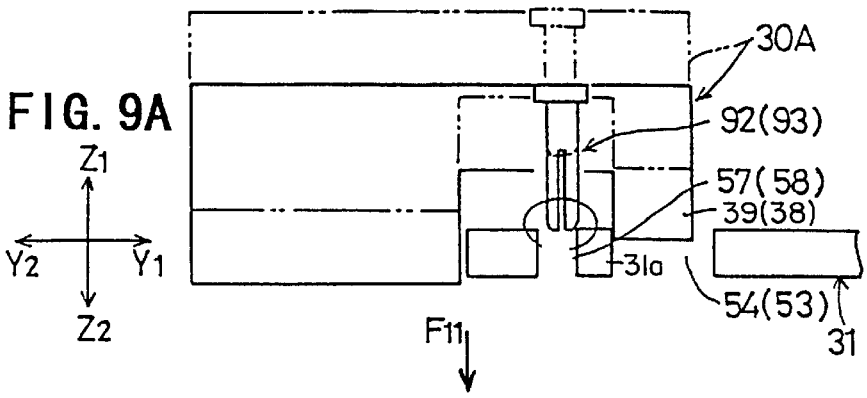
FIGS. 9A to 9D are diagrams showing processes for temporarily fixing and then mounting the connector of the second embodiment on the printed-circuit board.
Figures 1, 9A:
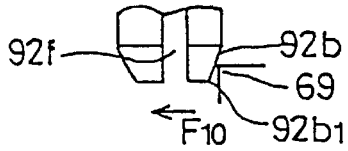

As shown in FIG. 9A, the connector 30A is lowered to a position at an end of the printed-circuit board 31 and then pressed with a comparatively strong force F11 in the Z2 direction.

When the connector 30A is lowered to the position at the end of the printed-circuit board 31, the lower end side of the hook part 39 (38) fits in the notch part 54 (53). As indicated in an enlarged view in FIG. 9A, the tapered part 92*b* of the pin 92 abuts the edge part 69 at a location closer to the tip 92*b*1.

Figure 9B:
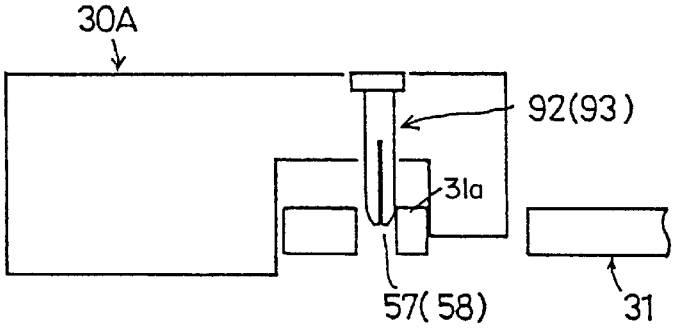

When the connector 30A is pressed with a comparatively strong force F11 in the Z2-direction, the hook part 39 (38) further proceeds into the notch part 54 (53). The tapered part 92*b* is relatively pushed by the edge part 69, thus providing a relatively strong force F10 to the lower half part 92*e* of the pin 92 in the Y2-direction. As shown in 8B, the slit 92*f* is narrowed and the lower half part 92*e* is elastically deformed such that the diameter is decreased. The diameter is indicated by reference d11. Thus, the pin 92 is inserted into the opening 57 as shown in FIG. 9B.

Figure 9C:
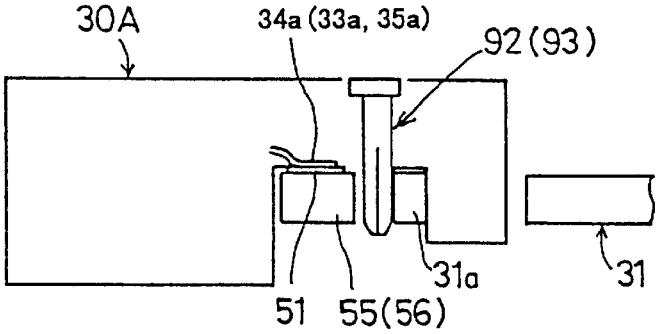

The connector 30A is in a temporarily fixed state in FIG. 9C and FIG. 8B. In the temporarily fixed state, the hook part 39 (38) is completely fitted in the notch part 54 (53), the protruded part 92*e* of the pin 92 is completely fitted in the opening 57 and the other pin 93 is completely fitted in the opening 58. The arm parts 40, 41, shown in FIG. 7, are supported by the supporting parts 55, 56. Thus, the connector main body 32 is protruded out from the end surface 50 of the printed-circuit board 31 in the Y2 direction.

With regards to the part inserted into the opening 57 (58), the pin 92 (93) is energized by an elastic force F20 which can restore the original diameter d10. With this force F20, the part 31*a*, with the size B, of the printed-circuit board 31 is securely held between the pin 92 (93) and the hook part 39 (38). Therefore, the connector 30A is temporarily fixed such that it is not inclined with respect to the printed-circuit board 30 and the terminal portions 33*a*, 34*a*, 35*a* abut the corresponding pads 51.

Note that the temporal fixing may be implemented in an efficient manner, since, as shown in FIG. 9A, the user only needs to lower the connector 30A to the end position of the printed-circuit board 31, and then press in the Z2 direction with the comparatively strong force F11.

Figure 9D:
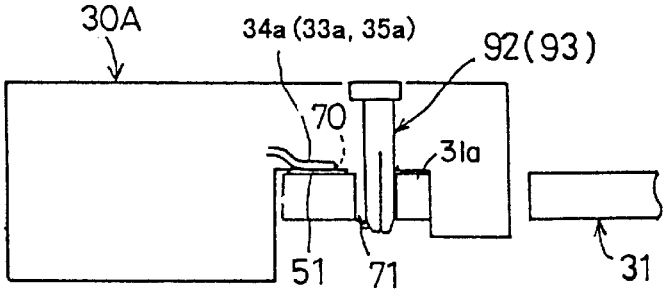

As shown in FIG. 9D, the terminal portions 33*a*, 34*a*, 35*a* are soldered on the corresponding pads 51 by solder 70. Since the terminal portions 33*a*, 34*a*, 35*a* abut the corresponding pads 51 in the temporarily fixed state, the soldering process is implemented with high reliability. Also, the pin 92 (93) is soldered on the opening 57 (58) by solder 71.

Thereby, the connector 30A is mounted on the printed-circuit board 31. The pin 92 (93) enhances a fixing force of the power supply connector part 30*b* to the printed-circuit board 31.

In is to be noted that the pin 92 (93) is not limited to the above-described structure, as long as the pin 92 (93) is energized with the elastic force F20 when fitted in the opening 57 (58).

Also, the opening 57 may be provided with a conical tapered part at the upper end opening side, instead of providing the tapered part 92*b* on the pin 92.

Further, the present invention is not limited to these embodiments, but variations and modifications may be made without departing from the scope of the present invention.

The present application is based on Japanese priority application No.10-219242 filed on Aug. 3, 1998 the entire contents of which are hereby incorporated by reference.

What is claimed is:

1. A connector comprising:

connector main body having a plurality of terminals and hook parts engagable with notch parts of a printed-circuit board to temporarily fix said connector to said printed-circuit board;

pins received in corresponding bores in said connector main body and which move within a small region within the corresponding bores when said pins are forced to move;

to achieve said temporarily fixed state, said pins are forced to move slightly so that the pins are fitted into openings provided in said printed-circuit board, and said connector further comprising a power supply connector part connectable to a power supply connector, said pins being provided at positions adjacent to said power supply connector part.

2. The connector as claimed in claim 1, further comprising:

a pair of arms extending in parallel from said main body adjacent respective opposite edges of, and reinforcing, the power supply connector part; and the bores, receiving the corresponding pins, being formed in the respective arms.

3. A connector, comprising:

connector main body having a plurality of terminals and hook parts engageable with notch parts of a printed-circuit board to temporarily fix said connector to said printed-circuit board, bores in said connector main body, each bore being defined, and surrounded, by a side wall and being formed such that its top cross section is circular and its bottom cross section is elliptical with a major axis of the bore extending in a direction corresponding to a depth of the connector;

pins penetrating through said bores, each of said pins being pivotable about a center of said top cross section within a small region defined by the side wall, a lower half part of said pin protruding downwardly from said bore being movable in a direction toward a front of the connector when a forward force is exerted on said lower half part; and to achieve said temporarily fixed state, said pins are forced to pivot slightly so that the lower half parts of the pins are fitted into openings provided in said printed-circuit board.

4. The connector as claimed in claim 3, wherein each said pin is provided with a plurality of ribs protruding from the periphery of an upper half part of the pin.

5. The connector as claimed in claim 3, wherein:

each said pin has a tapered part at a bottom end of said lower half part of the pin, and said pin is slightly moved so as to fit the pin into the opening provided in said printed-circuit board with its tapered part being guided to an edge part of the opening of said printed-circuit board.

6. The connector as claimed in claim 3, further comprising:

a power supply connector part connectable to a power supply connector, said pins being provided at positions adjacent to said power supply connector part.

7. The connector as claimed in claim 3, further comprising:

a pair of arms extending in parallel from said main body adjacent respective opposite edges of, and reinforcing, the power supply connector part; and the bores, receiving the corresponding pins, being formed in the respective arms.

8. A connector, comprising:

a connector main body having a plurality of terminals and having hook parts engageable with notch parts of a printed-circuit board to temporarily fix said connector to said printed-circuit board;

pins received in corresponding bores in the connector main body, each of said pins being constructed such that a lower half part of said pin, protruding downwardly from the connector main body, is elastically deformable so that a diameter of the pin decreases;

to achieve said temporarily fixed state, said lower half parts of the pins are elastically deformed so as to be fitted into corresponding openings provided therefor in said printed-circuit board; and said connector further comprising a power supply connector part connectable to a power supply connector, said pins being provided at positions adjacent to said power supply connector part.

9. The connector as claimed in claim 8, wherein said pin is elastically deformed so that the diameter of the pin decreases, with its tapered part being guided to an edge part of the opening of said printed-circuit board.

10. The connector as claimed in claim 8, further comprising:

a pair of arms extending in parallel from said main body adjacent respective opposite edges of, and reinforcing, the power supply connector part; and the bores, receiving the corresponding pins, being formed in the respective arms.

11. A connector for mounting on a portion, having electrical connection pads thereon, of a first main surface of a printed circuit board adjacent a front edge thereof, comprising:

a connector main body having a width dimension and plural electrical terminals extending in parallel through the connector main body from a front side of the connector main body and with respective projection portions extending in parallel from a rear side of the connector main body, the projection portions to engage respective electrical connection pads on the upper main surface of the printed circuit board;

first and second arms of the connector main body extending in parallel with and spaced from the terminal projection portions and having respective first and second downwardly projecting hooks, receivable in corresponding first and second notches in respective first and second side edges, displaced from the front edge, of the printed circuit board; and first and second pins received through respective first and second bores in the connector main body and through respective, and generally aligned, third and fourth bores in the printed circuit board, each pin being deflected, from an axial path which is transverse to the first main surface of the printed circuit board and the connector upon being inserting through the respective bores of the connector main body and the printed circuit board, so as to exert a lateral, resilient compressive force on corresponding first and second portions, intermediate the respective bore and notch, of the printed circuit board.

12. The connector as claimed in claim 11, wherein:

the connector main body has a plurality of terminals and has first and second hook parts engageable with notch parts of a printed-circuit board to temporarily fix said connector to said printed-circuit board, first and second bores in said connector main body, each bore being defined and surrounded by a side wall and being formed such that the top cross section if the bore is circular and a bottom cross section if the bore is elliptical, with a major axis of the bore extending in a direction corresponding to a depth of the connector;

pins penetrating through said bores, each of said pins being pivotable about a center of said top cross section within a small region defined by the side wall, a lower half part of said pin protruding downwardly from said bore being movable in a direction toward a front of the connector when a forward force is exerted on said lower half part, and, to achieve said temporarily fixed state, said pins are forced to pivot slightly so that the lower half parts of the pins are fitted into openings provided in said printed-circuit board and impose a lateral force, transverse to the major access of the bore and engaging a corresponding portion of the printed circuit board between the hook parts and the respective bores.

13. The connector as claimed in claim 11, wherein each said pin is provided with a plurality of ribs protruding from the periphery of an upper half part of the pin.

14. The connector as claimed in claim 11, wherein:

each said pin has a tapered part at a bottom end of the lower half part of the pin, and said pin is slightly moved so as to fit the pin into the opening provided in said printed-circuit board with its tapered part being guided to an edge part of the opening of said printed-circuit board.

15. The connector as claimed in claim 11, further comprising:

a power supply connector part connectable to a power supply connector, the pins being provided at positions adjacent to said the supply connector part.

16. he connector as claimed in claim 11, wherein said pin is elastically deformed so that the diameter of the pin decreases, with its tapered part being guided to an edge part of the opening of said printed-circuit board.

* * * * *

UNITED STATES PATENT AND TRADEMARK OFFICE

CERTIFICATE OF CORRECTION

PATENT NO.: 6,162,091
DATED : December 19, 2000
INVENTOR(S): Fumio KUROTORI et al.

It is certified that error appears in the above-identified patent and that said Letters Patent is hereby corrected as shown below:

Col. 9, line 20, before "connector" insert --a---;
line 43, before "connector" insert --a--.

Col. 12, line 26, change "he" to --The--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*